United States Patent [19]

Salzgeber

[11] Patent Number: 4,457,284

[45] Date of Patent: Jul. 3, 1984

[54] COLD TEMPERATURE ADVANCE MECHANISM

[75] Inventor: Daniel E. Salzgeber, Windsor, Conn.

[73] Assignee: Stanadyne, Inc., Windsor, Conn.

[21] Appl. No.: 46,548

[22] Filed: Jun. 7, 1979

[51] Int. Cl.[3] ..... F02M 59/20

[52] U.S. Cl. ..... 123/502; 123/501

[58] Field of Search ..... 123/139 AQ, 139 AP, 123/139 AL, 140 FG, 140 MC, 139 ST, 179 G, 139 E, 501, 502; 417/218

[56] References Cited

U.S. PATENT DOCUMENTS

| | | | |
|---|---|---|---|
| 3,433,159 | 3/1969 | Kemp | 123/139 AQ |
| 3,943,902 | 3/1976 | Skinner | 123/139 AQ |
| 4,050,433 | 9/1977 | Takashiki | 123/139 AQ |
| 4,079,719 | 3/1978 | Varcoe et al. | 123/139 AQ |
| 4,122,813 | 10/1978 | Barnert et al. | 123/139 AQ |
| 4,142,499 | 3/1979 | Salzgeber | 123/140 MC |
| 4,183,342 | 1/1980 | Lohner | 123/139 AP |
| 4,214,564 | 7/1980 | Skinner | 123/502 |

*Primary Examiner*—Magdalen Y. C. Moy

*Attorney, Agent, or Firm*—Prutzman, Kalb, Chilton & Alix

[57] ABSTRACT

A fuel injection pump having a mechanically adjustable servo valve for controlling the timing of the pumping event is disclosed. A pivoted lever has one end which engages the spring seat of a timing control plunger servo valve which is also subjected to a speed related hydraulic signal and another end in the form of a bimetal strip which engages a cam clamped on the throttle shaft to pivot the lever according to the rotational position of the shaft. The profile of the cam is such as to retard the timing of the pumping stroke when the charge delivered by the pump is increased to delay pressure built up in the pump so that injection pressure in the associated nozzle is reached at a scheduled crankshaft angle regardless of variations in speed and load on the engine. A heater for the bimetal strip is provided to shift the servo spring seat to change the timing of injection upon demand or automatically under a prescribed engine operation condition. In one embodiment, the bimetal provides 3°–4° more advance when the engine is cold to compensate for the delayed ignition of the fuel.

25 Claims, 5 Drawing Figures

COLD TEMPERATURE ADVANCE MECHANISM

This invention is an improvement in the invention disclosed and claimed in copending application Ser. No. 959,908 filed Nov. 13, 1978 and now U.S. Pat. No. 4,224,916 in the name of Charles W. Davis and assigned to the assignee of the present invention. It relates to an improved fuel injection pump of the type used for the sequential delivery of measured charges of fuel under high pressure to the cylinders of compression-ignition engines and more particularly to an improvement in such fuel pumps wherein the timing of injection of fuel into the cylinders of the engine is controlled in response to other engine operationg conditions as well as changes in the load and speed of the engine.

In the operation of internal combustion engines where fuel injection is employed, a metered charge of liquid fuel is delivered under high pressure to each engine cylinder in synchronism with the engine operation cycle. In injection pumps having inlet metering and wherein the contour of a cam is translated into pumping strokes of plungers actuated by the cam, there is a fixed termination of the pumping event for a fixed adjustment of the pumping cam. In order to obtain best performance and control exhaust emissions in such pumps, it is desirable to advance the timing of the pumping event relative to the engine operating cycle when engine speed is increased so that fuel injection is not delayed as speed increases. In addition, it is desirable for fuel injection to begin at an earlier engine crank angle when the engine is cold and under other engine operating conditions.

Accordingly, it is a principal object of the invention to provide a new and improved fuel injection pump of the type described which includes a pump timing control which advances the timing of the pumping event as required for efficient operation and exhaust emissions control so that injection of fuel will begin at an earlier engine crank angle under varying engine operating conditions, such as cold engine temperature and at high altitudes to compensate for the delays in ignition of the fuel which occur under such conditions. Included in this object is the provision of an injection pump timing control which provides more readily reproducible results from pump to pump.

It is another object of the invention to provide such a fuel injection pump having a thermally adjustable timing control for the pumping event which is simple in design, predictable in performance, and is readily adapted to provide any desired amount and schedule of timing change with changes in load and speed.

It is yet another object of the invention to provide such a fuel injection pump having a mechanically adjustable servo valve for controlling the timing of the pumping event according to the amount of fuel being delivered to the engine.

Other objects will be in part obvious and in part pointed out in more detail hereinafter.

A better understanding of the invention will be obtained from the following description and the accompanying drawings of an illustrative application of the invention.

Figure 1:
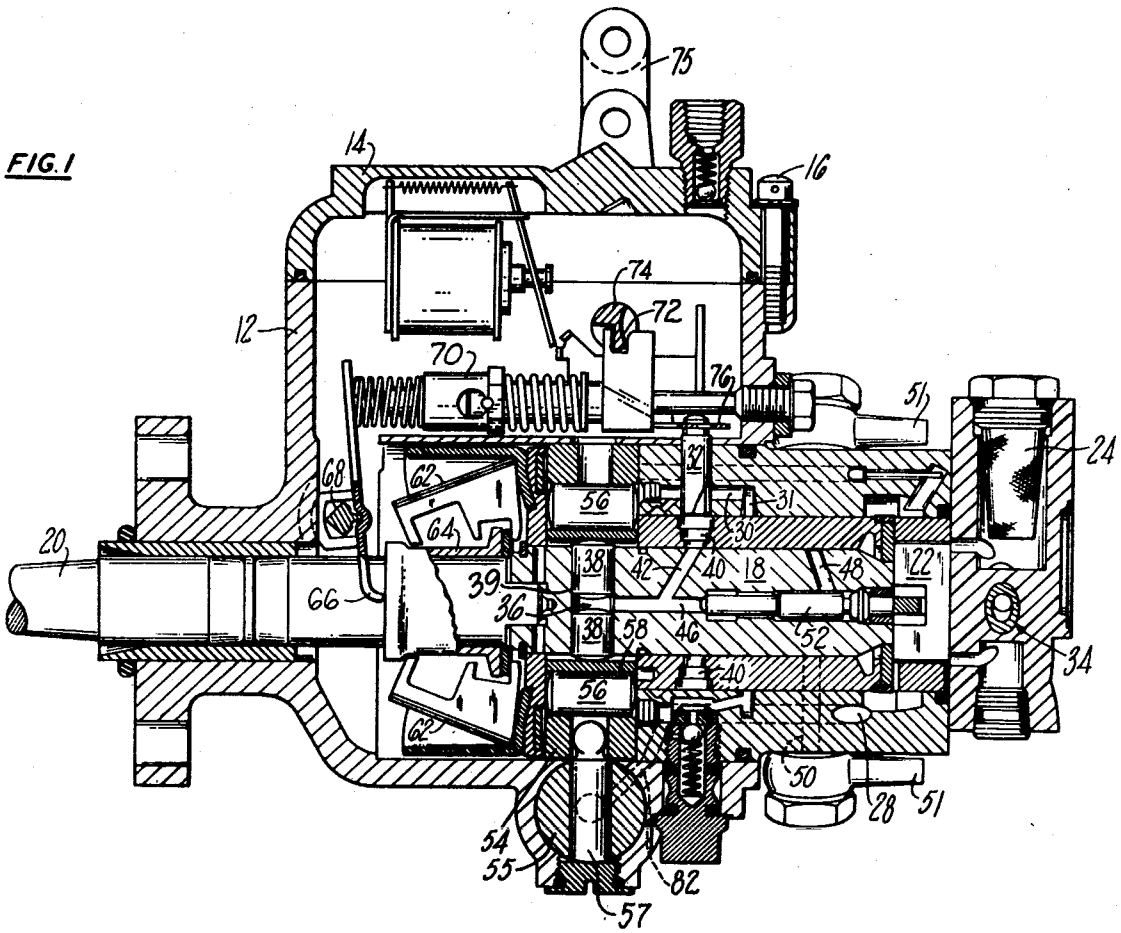
FIG. 1 is a longitudinal side elevational view, partly in section and partly broken away, of a fuel injection pump illustrating a preferred embodiment of the present invention.

Referring now to the drawings in detail, the fuel pump exemplifying the present invention is shown to be of the type adapted to supply sequential measured pulses or charges of fuel under high pressure to the several fuel injection nozzles of an internal combusition engine. The pump has a housing 12 provided with a cover 14 secured thereto by fasteners 16. A fuel distributing rotor 18 having a drive shaft 20 driven by the engine is journaled in the housing.

A vane-type transfer or the low pressure supply pump 22 is driven by the rotor 18 and receives fuel from a supply tank (not shown) through pump inlet 24. The output of the pump 22 is delivered under pressure via axial passage 28, annulus 31 and passage 30 to metering valve 32. A transfer pump pressure regulating valve, generally denoted by the numeral 34, regulates the output pressure of the transfer pump and returns excess fuel to the pump inlet 24. The regulator 34 is designed to provide transfer pump output pressure which increases with engine speed in order to meet the increased fuel requirements of the engine at higher speeds and to provide a fuel pressure suitable for operating auxiliary mechanisms of the fuel pump.

A high pressure charge pump 36 comprising a pair of opposed plungers 38, mounted for reciprocation in a diametral bore 39 of the rotor, receives metered inlet fuel from the metering valve 32 through a plurality of angularly spaced radial ports 40 (only two of which are shown) adapted for sequential registration with a diagonal inlet passage 42 of rotor 18 as it is rotated.

A charge of fuel is pressurized to high pressure by the charge pump 36 and is delivered through an axial bore 46 of the rotor to a delivery passage 48 which registers sequentially with a plurality of angularly spaced outlet passages 50 (only one of which is shown) which communicate respectively with the individual fuel injection nozzles of the engine through discharge fittings 51 spaced around the periphery of the housing 12. A delivery valve 52 in the axial bore 46 operates to achieve sharp cut-off of fuel to the nozzles at the end of the pumping stroke of charge pump 36 to eliminate fuel dribble into the engine combustion chambers.

The angularly spaced passages 40 to the charge pump 36 are located around the periphery of the rotor bore to provide sequential registration with the diagonal inlet passage 42 of the rotor 18 during the intake stroke of the plungers 38, and the angularly spaced outlet passages 50 are similarly located to provide sequential registration with the distributor passage 48 during the compression stroke of the plungers.

An annular cam 54 having a plurality of pairs of diametrically opposed camming lobes is provided for simultaneously actuating the charge pump plungers 38 inwardly for periodically pressurizing the charge of fuel therebetween to thereby periodically deliver sequential charges of pressurized fuel to the engine. A pair of rollers 56 carried by roller shoes 58 are mounted by the rotor in radial alignment with the plungers 38 for camming the plungers inwardly.

For timing the distribution of the pressurized fuel to the fuel nozzles in proper synchronism with the engine operation, the annular cam 54 is adapted to be angularly adjusted by a suitable timing control piston 55 which is connected to cam 54 by connector pin 57.

A plurality of governor weights 62, mounted around pump shaft 20 for rotation therewith, provide a variable axial force on a sleeve 64 which is slidably mounted on shaft 20. The sleeve engages pivoted governor arm 66 to urge it clockwise, as viewed in FIG. 1, about a supporting pivot 68.

The governor arm 66 is urged in the opposite pivotal direction by a governor spring assembly 70, the axial position of which is adjustable by a cam 72 operated by throttle shaft 74 which is connected to the throttle arm 75. The throttle arm in turn is connected to the controlling footpedal in the driver's compartment of the automobile.

The governor arm 66 is connected to control the angular position of the metering valve 32 through control arm 76 which is fixed to the metering valve in a manner fully described in U.S. Pat. No. 4,142,499 which issued Mar. 6, 1979 to Daniel E. Salzgeber and is entitled Temperature Compensated Fuel Injection Pump.

As well known, the quantity or measure of the charge of fuel delivered by the charge pump in a single pumping stroke is readily controlled by varying the restriction offered by the metering valve 32 to the passage of fuel therethrough.

As described in the aforesaid copending application, the governor automatically regulates the engine speed in the idle speed range and a maximum speed with the metering of fuel at intermediate speeds being controlled solely by the mechanical acutation of the throttle foot pedal.

Figure 2:
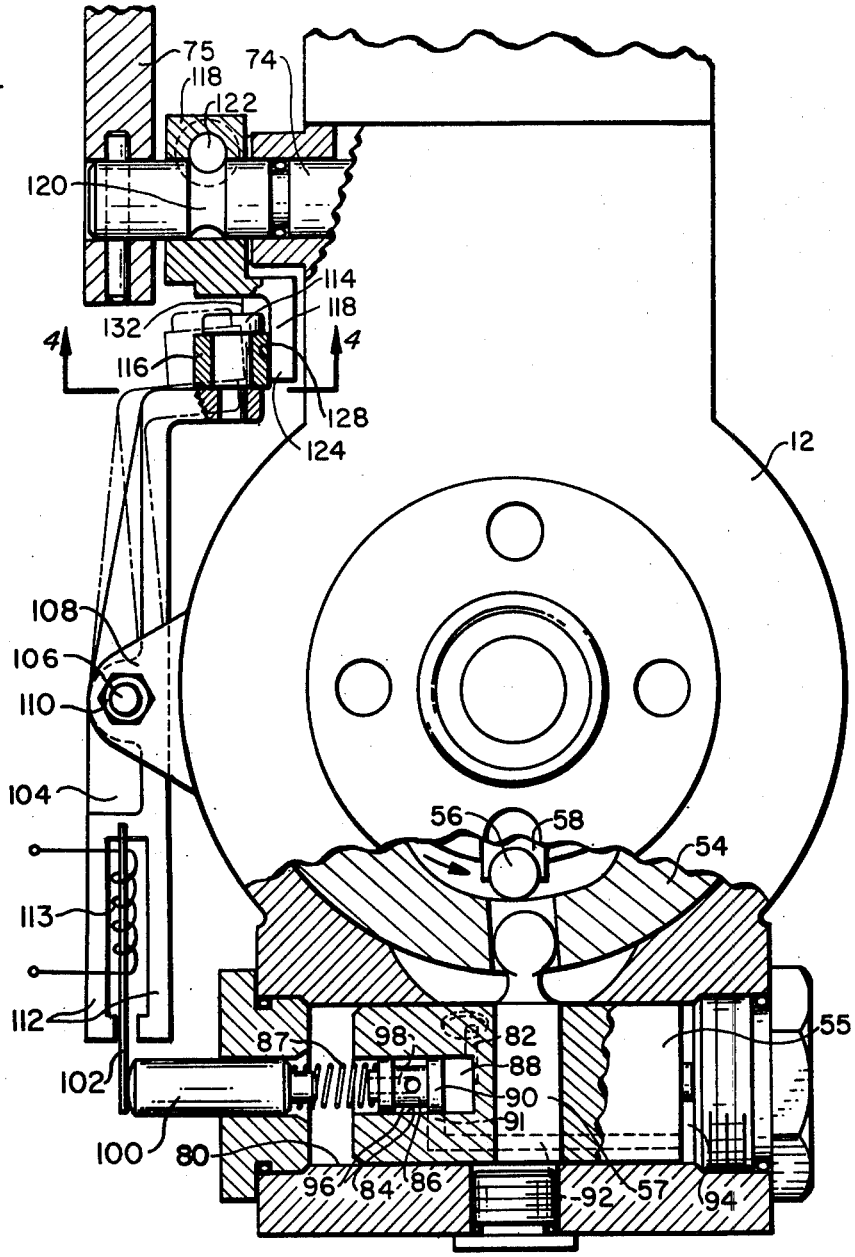
FIG. 2 is an enlarged end view, partly in section and partly broken away, of the fuel injection pump of FIG. 1.

Referring now specifically to FIG. 2, timing control piston 55 is slidably mounted in a transverse bore 80 which is parallel to throttle shaft 74. A passage 82 provides communication with the bore 80 and with axial output passage 28 from the transfer pump 22 to deliver regulated transfer pump output pressure thereto.

Piston 55 provides and axial bore 84 in which a servo valve 86 is slidably mounted. A servo biasing spring 87 engages one end of servo valve 86 to bias the servo valve to the right as shown in FIG. 2. In operation, regulated transfer pump output pressure is continuously present in valve chamber 88 at one end of the servo valve 86 to exert a force on the servo valve in opposition to the biasing force of spring 87. Inasmuch as the output pressure of the transfer pump is a function of engine speed, the position of servo valve 86 is dependent on engine speed.

As the pressure in valve chamber 88 increases with increased engine speed, it compresses the spring so that the land 90 of the servo valve uncovers the port 91 of passage 92 so that fuel may pass from chamber 88 into piston chamber 94 at the end of timing control piston 55. As the quantity of fuel in chamber 94 increases, it moves timing control piston 55 to the left until the land 90 covers the port 91 of passage 92 to terminate fuel flow between valve chamber 88 and piston chamber 94 at the equilibrium position of timing control piston 55 which fixes the angular position of cam 54 and the timing of injection.

If engine speed decreases, the pressure in valve chamber 88 decreases and the biasing force of servo spring 87 moves the servo piston to the right to provide communication between passage 92 and annulus 96 to dump fuel from the piston chamber 94 through bore 98 which communicates with the interior of the pump housing 12 until the equilibrium position of timing control piston 55 is again reached.

As shown in FIG. 2, one end of the servo spring 87 engages axially slidable spring seat 100, the axial position of which is determined by a stop 102 secured to 104 which is pivoted by an eccentric pivot 106. Pivot 106 is mounted by a pair of ears 108 projecting from the side of pump housing 12.

The opposite end of the lever 104 is provided with an axially extending cylindrical boss 114 on which a roller 116 is journaled.

As best shown in FIG. 2, a face cam 118 is adjustably clamped to throttle shaft 74 which is provided with an annular groove 120 to receive a portion of the clamping screw 122 to fix the axial position of the face cam 118 with respect to the throttle shaft 74.

The face cam 118 is provided with a radially projecting flange 124 providing a cam surface having a flat portion 128 at one end thereof, an intermediate sloping portion 130, and a flat portion 132 at the other end.

Roller 116 of lever 104 is engagable with the cam surfaces of face cam 118 to pivot the lever 104 thereby to shift servo spring seat 100 mechanically in accordance with the rotational position of throttle shaft 74. When the throttle arm 75 is rotated to a low load position, the roller 116 engages the flat cam surface 128 as shown in solid lines to shift the stop 100 the fullest distance to the left as viewed in FIG. 2 thereby to cause the timing control piston 55 to move to a position providing the maximum advance in injection timing for a given engine speed. As the throttle arm 75 is rotated from the position illustrated in FIG. 2 toward its full load position, the roller 116 engages the upwardly inclined ramp portion 130 of the face cam 118 as shown by the dashed lines of FIG. 3 to pivot the lever arm 104 in a direction to move the servo spring seat 100 to the right to dump some fuel from chamber 94 to retard the timing of injection.

Figure 3:
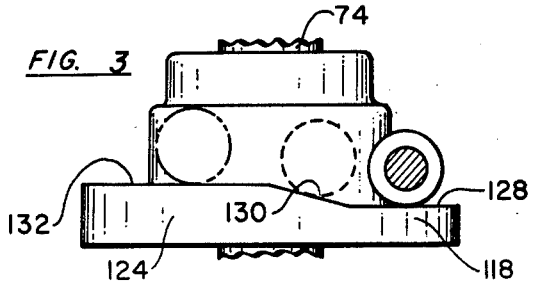
FIG. 3 is a fragmentary view taken along the lines 4—4 of FIG. 2.

As the throttle arm 75 is moved further toward its full load position, the cam member 118 is rotated so that the roller 116 engages the highest flat surface 132 of the cam as shown by a broken line in FIG. 3 to depress the servo spring seat 100 the maximum amount and thereby cause the timing control piston 55 to move to retard the timing the maximum amount for a given engine operating speed.

Since the metering valve 32 is controlled directly by the position of throttle arm 75 above the idle speed range, the shift in the angular position of the throttle shaft 74 is essentially proportional to the load on the engine. Moreover, the profile and the length of the sloping cam portion 130 may be varied to change the portion of the load range and the amount of change in injection timing which will result from a given change in load level. Further, by controlling the axial distance between cam portions 128 and 132, the maximum amount of change in injection timing which may be obtained by changes in the load level on the engine may be easily varied.

According to this invention, the stop 102 is a thermal responsive element, such as a bimetallic strip which is shown in FIG. 2 as being cantilever mounted by lever 104 between the legs 112 formed by its bifurcated end. The free ends of the legs 112 serve to limit the flexure of the bimetallic strip to provide the desired amount of change in advance which is desirably fixed at, say, 3°–4° of crankshaft rotation.

The metallic strip is mounted by the lever 104 to engage the end of the outer leg 112 (to the left as shown in FIG. 2) to provide an additional advance in injection timing and to engage the inner leg 112 to provide normal injection timing.

In order to adjust the injection timing, the output pressure of the transfer pump is first adjusted. The throttle arm 75 is then moved to open the metering valve to its full open position at a prescribed pump speed and the bimetal strip is fixed in its normal operating position against the inner leg 112 (to the right as shown in FIG. 2). The eccentric pivot 106 is then adjusted to provide the desired amount of injection timing advance with the face cam 118 angularly adjusted so that the roller 116 engages the full load flat portion 132 of the face cam 118. After this adjustment is made and lock nut 110 is tightened, the metering valve is positioned for a part-load condition where the roller engages on the sloping portion 130 of the face cam 118, and the face cam is angularly adjusted with respect to the throttle shaft until the desired injection timing is obtained. The adjusting screw 122 is tightened to clamp the face cam 118 to the throttle shaft 74.

Such adjustment ties the timing of the pumping event directly to the throttle shaft position and to engine speed and, since the face cam is easily adjustable with respect to the throttle shaft position, the timing of injection under given speed and load conditions is easily reproducible from pump to pump and is predictable despite manufacturing variations from pump to pump.

With such adjustment, the air quality standards for hydrocarbon emissions can be met when the engine is operating in its normal operating temperature range and at sea level. However, when the engine is being started and before it has reached its normal operating temperature, or is operating at an altitude of 5,000 feet or more, the compression level in the combustion chamber needed for ignition is delayed and the burning of the fuel is less complete. This invention provides a solution to these problems.

Figure 4:
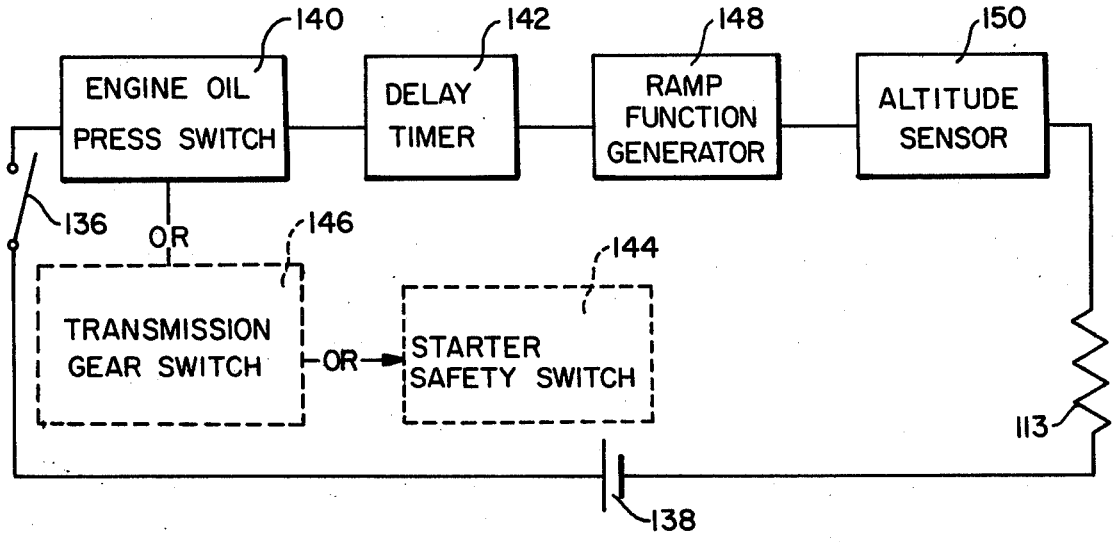
FIG. 4 is a schematic diagram showing one form of control circuit suitable for use in the practice of the invention.

FIG. 4 illustrates a schematic electrical control circuit wherein a thermal responsive device, specifically a bimetal strip, provides the stop 102. In the embodiment illustrated in FIG. 2, the bimetal strip bottoms against the outer leg 112 of lever 104 when it is cold. This provides an additional advance in the timing of the pumping stroke so that injection occurs earlier in the combustion cycle to that there is an additional amount of time to complete the combustion process as required when the engine is cold.

The control circuit includes the ignition switch 136 and a second switch which is closed when the engine is being started or has started is placed in series with the ignition switch 136. Such a second switch may, for example, be an engine oil pressure switch 140, which is closed when the engine oil pressure reaches a prescribed minimum level, or the conventional starter safety switch 144 used with automatic transmissions and is closed when the transmission is in "Neutral" or in "Park", or a special transmission gear switch 146 which is closed when the car is in "Drive" but is open when the transmission is in "Neutral". The latter alternative switch is desirable where the engine temperature drops below the normal operating temperature when the transmission is in "Neutral".

In the preferred embodiment, the electric control circuit also includes another series switch 142 involving a delay timer which will delay the energization of the heater 113 for a fixed or a variable period of time after switch 140, 144, 146 is closed. It is desirable that the delay timer include a thermal sensing device which increases the delay as ambient temperature decreases. Another electrical control device such as a ramp function generator 148 may also be used to control the rate of heating of the bimetal strip by the heater 113 by controlling the voltage applied across the heater. Such a control device may control the applied voltage according to a prescribed schedule, or may shift the voltage applied to the heater 113 in a single step so that the period of time required for the heater to reach the level at which the bimetal strip is bottomed against the right-hand leg 112 of the lever 104 is delayed for the desired period of time which may be up to three minutes or more, so that the engine reaches its normal operating temperature.

Finally, as shown in FIG. 4, the heater control circuit includes an altitude sensor 150, which will de-energize the heater and provide the increased advance at high altitude. The altitude sensor includes a normally closed switch which opens at an altitude of say 5,000 feet to de-energize the heater control circuit and provide additional advance in the timing of injection with the resultant reduction in the hydrocarbon emissions when the intake air manifold pressure is low as at high altitudes.

Figure 5:
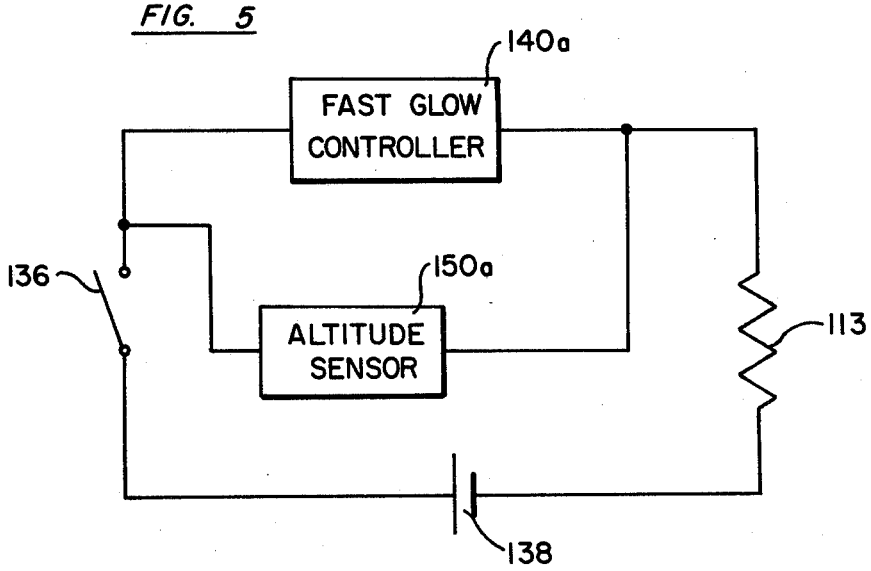
FIG. 5 is a schematic diagram showing another form of such a control circuit.

An alternate control circuit is shown in FIG. 5.

This control circuit is suited for use in a design wherein the bimetal strip is bottomed against the right leg 112 of the lever when it is not heated by the heater 113 to provide the normally adjusted advance for operation when the engine is warmed up. In this alternative circuit, the bimetal is bottomed against the left-hand leg 112 of the lever when it is heated to provide additional advance during warm up and at high altitudes. With this circuit, any malfunction in the control circuit will cause the timing to be correctly adjusted for operation under normal conditions. As shown, a fast glow controller **140*a* will energize the glow plug of the engine as required for starting in a few, say, 4–6 seconds, and also energize the heater 113 so that the bimetal strip provides the decreased additional timing advance for starting simultaneously. In this alternative, the cooling off period of the bimetal strip provides for the gradual retarding of injection as the engine warms up. The altitude sensor 150*a* includes a normally open switch connected in parallel with the fast glow controller 140*a*** so that, at high altitudes, the altitude sensor will cause the heater to energize and provide the desired timing advance at high altitudes.

As will be apparent to persons skilled in the art, various modifications, adaptations and variations of the foregoing specific disclosure can be made without departing from the teachings of the present invention.

I claim:

1. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, an electrical control circuit for energizing the heater, a rotatable throttle shaft and a pivoted lever having one end engaging the movable spring seat and another end engaging a cam fixed to the throttle shaft so that rotation of the throttle shaft to change the quantity of fuel delivered by a pumping stroke mechanically shifts the spring seat to change the biasing force of the servo valve biasing spring during at least a portion of the load range of the engine to change the timing of the pumping strokes.

2. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater including means responsive to ambient air pressure to control the energization of the heater.

3. A fuel injection pump according to claim 2 including means acting on the movable spring seat to change the biasing force of the biasing spring and alter the timing of the pumping strokes with changing fuel delivery during at least a portion of the load range of the engine.

4. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater including an engine condition responsive switch for energizing the heater, the engine condition responsive switch being an engine oil pressure switch.

5. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater including an engine condition responsive switch for energizing the heater, the engine condition switch being a transmission gear switch which controls the energization of a heater to advance injection timing when the transmission is in neutral and to retard the timing when the transmission gears are engaged.

6. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater including an engine condition responsive switch for energizing the heater, the engine having an automatic transmission and the engine condition responsive switch being the starter safety switch.

7. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater including an engine condition responsive switch for energizing the heater and a second switch in series with the engine condition responsive switch, the second switch including means for delaying the energization of the heater for varying periods of time.

8. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater including an engine condition responsive switch for energizing the heater and a second switch in series with the engine condition responsive switch, the second switch controlling the energization of the thermal responsive element in accordance with changes in altitude.

9. A fuel injection pump according to claim 4 including means acting on the moveable spring seat to change the biasing force of the biasing spring and alter the timing of the pumping strokes with changing fuel delivery during at least a portion of the load range of the engine.

10. A fuel injection pump according to claim 5 including means acting on the moveable spring seat to change the biasing force of the biasing spring and alter the timing of the pumping strokes with changing fuel delivery during at least a portion of the load range of the engine.

11. A fuel injection pump according to claim 6 including means acting on the moveable spring seat to change the biasing force of the biasing spring and alter the timing of the pumping strokes with changing fuel delivery during at least a portion of the load range of the engine.

12. A fuel injection pump according to claim 7 including means acting on the moveable spring seat to change the biasing force of the biasing spring and alter the timing of the pumping strokes with changing fuel delivery during at least a portion of the load range of the engine.

13. A fuel injection pump according to claim 8 including means acting on the moveable spring seat to change the biasing force of the biasing spring and alter the timing of the pumping strokes with changing fuel delivery during at least a portion of the load range of the engine.

14. A fuel injection pump having pumping plungers to deliver measured charges of fuel in sequential pumping strokes and timing means to vary the timing of the pumping strokes relative to the operation of an associated engine, means forming a closed cylinder, a timing control piston in the closed cylinder connected with the timing means for actuating the same, a passageway communicating with the closed cylinder, a servo valve slidably mounted in a bore intersecting said passageway for controlling the entry of fluid into and the dumping of fluid out of said closed cylinder, a servo valve biasing spring, a source of fluid under a pressure correlated with engine speed acting on the servo valve against the bias of the biasing spring, a movable spring seat for the servo valve biasing spring, a thermal responsive element for shifting the movable spring seat to change the force applied by the biasing spring on the servo valve, a heater for actuating said thermal responsive element, and an electrical control circuit for energizing the heater, the thermal responsive element being positioned to provide a prescribed timing of the pumping strokes and is shifted to retard the timing when the heater is energized.

15. A fuel injection pump according to claim 1 wherein said control circuit includes means responsive to ambient air pressure to control the energization of the heater.

16. A fuel injection pump according to claim 1 wherein the control circuit includes an engine condition responsive switch for energizing the heater.

17. A fuel injection pump according to claim 16 wherein the engine condition responsive switch is an engine oil pressure switch.

18. A fuel injection pump according to claim 16 wherein the engine condition switch is a transmission gear switch which controls the energization of a heater to advance injection timing when the transmission is in neutral and to retard the timing when the transmission gears are engaged.

19. A fuel injection pump according to claim 16 wherein the engine has an automatic transmission and the engine condition responsive switch is the starter safety switch.

20. A fuel injection pump according to claim 16 including a second switch in series with the engine condition responsive switch, the second switch including means for delaying the energization of the heater for varying periods of time.

21. A fuel injection pump according to claim 20 wherein the delaying means includes a temperature responsive element effective to control the period of time according to ambient temperature.

22. A fuel injection pump according to claim 16 including a second switch in series with the engine condition responsive switch, the second switch controlling the energization of the thermal responsive element in in accordance with changes in altitude.

23. A fuel injection pump according to claim 1 wherein the thermal responsive element is a bimetallic strip mounted by the lever to engage the spring seat, the end of the lever being bifurcated and spanning the bimetallic element to fix the limits of movement of the bimetallic strip.

24. A fuel injection pump according to claim 7 wherein the delaying means includes a temperature responsive element effective to control the period of time according to ambient temperature.

25. A fuel injection pump according to claim 12 wherein the delaying means includes a temperature responsive element effective to control the period of time according to ambient temperature.

* * * * *